US007358845B2

(12) United States Patent
Moffat

(10) Patent No.: US 7,358,845 B2
(45) Date of Patent: Apr. 15, 2008

(54) CABLE LIMITER AND CRAB LIMITER EMPLOYING REPLACEABLE FUSIBLE ELEMENT

(75) Inventor: John R. Moffat, Greenwood, SC (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/464,578

(22) Filed: Aug. 15, 2006

(65) Prior Publication Data

US 2008/0042796 A1 Feb. 21, 2008

(51) Int. Cl.
*H01H 85/30* (2006.01)
*H01H 85/143* (2006.01)

(52) U.S. Cl. ..... 337/237; 337/206; 337/241; 337/244

(58) Field of Classification Search ..... 337/206, 337/241–244, 203, 265, 267, 332, 376, 415, 337/237; 439/622, 250, 893; 174/84 C, 174/84 R
See application file for complete search history.

(56) References Cited

U.S. PATENT DOCUMENTS 2,222,642 A * 11/1940 Xenis ..... 337/192
2,259,053 A * 10/1941 Xenis ..... 337/159
2,267,006 A * 12/1941 Xenis ..... 337/188
2,282,279 A * 5/1942 Xenis ..... 337/291
2,289,207 A * 7/1942 Papp ..... 337/158
2,668,211 A * 2/1954 Matthysse ..... 337/192
3,594,750 A * 7/1971 Mueller ..... 340/590
3,750,075 A * 7/1973 Cooper, Jr. ..... 337/158
4,308,515 A * 12/1981 Rooney et al. ..... 337/162
5,055,817 A * 10/1991 O'Shields et al. ..... 337/161
5,274,528 A * 12/1993 Noschese et al. ..... 361/642
5,406,244 A * 4/1995 Thwaites et al. ..... 337/163
5,481,239 A * 1/1996 Di Troia ..... 337/206
5,847,913 A * 12/1998 Turner et al. ..... 361/93.1
6,046,665 A * 4/2000 Oh et al. ..... 337/191
6,060,990 A * 5/2000 Flegel ..... 340/584
6,359,227 B1 * 3/2002 Oh et al. ..... 174/84 R
6,642,833 B2 * 11/2003 Ranjan et al. ..... 337/231
2002/0041944 A1 * 4/2002 Stavnes et al. ..... 428/36.9
2004/0081782 A1 * 4/2004 Stavnes et al. ..... 428/36.3
2005/0231320 A1 * 10/2005 Ackermann ..... 337/206
2006/0076946 A1 4/2006 Shvach et al.

* cited by examiner

*Primary Examiner*—Anatoly Vortman
*Assistant Examiner*—Bradley H Thomas
(74) *Attorney, Agent, or Firm*—Martin J. Moran

(57) ABSTRACT

A cable limiter includes a main body having a cavity. The cavity of the main body is structured to receive a replaceable fusible element. An annunciator is housed by the main body. The annunciator is structured to annunciate status of the replaceable fusible element.

18 Claims, 6 Drawing Sheets

FIG. 4
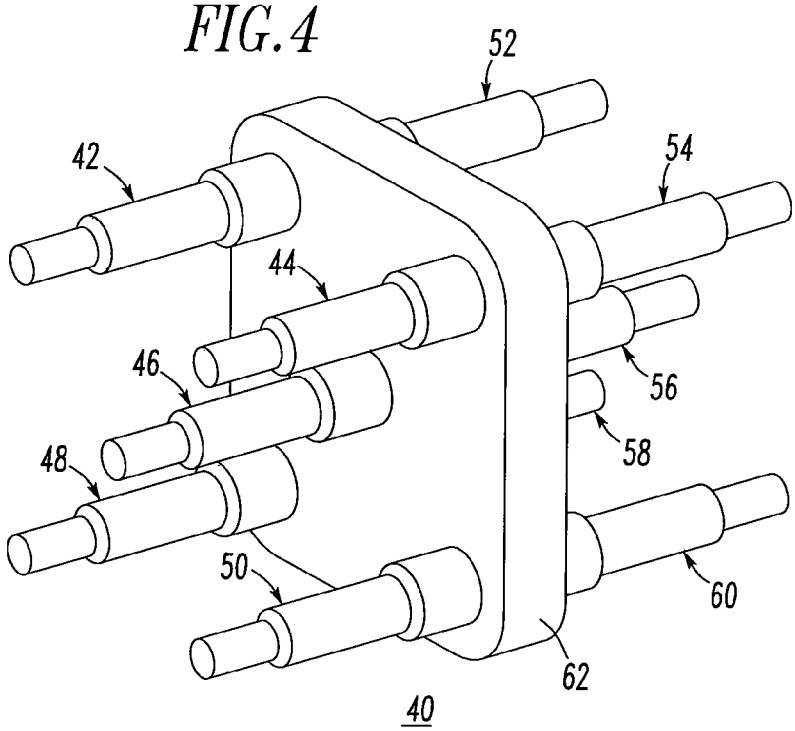
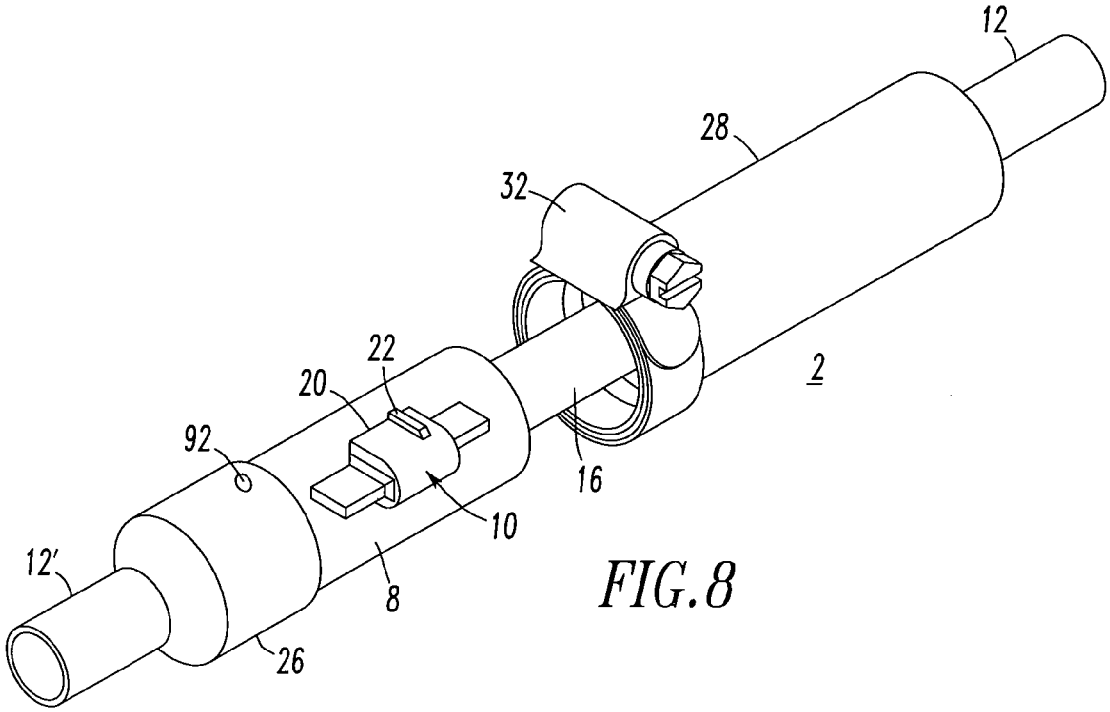
FIG. 8

CABLE LIMITER AND CRAB LIMITER EMPLOYING REPLACEABLE FUSIBLE ELEMENT

BACKGROUND OF THE INVENTION

1. Field of the Invention

This invention pertains generally to detection and annunciation apparatus and, more particularly, to such apparatus for detecting and annunciating when a cable limiter or a crab limiter section is operable or when it operates and clears a power circuit. The invention also relates to cable limiters including a fusible element.

2. Background Information

Cable limiters and crab limiters electrically connect and protect low voltage underground secondary network power cables, which make up the backbone of a secondary network power distribution system. The cable limiters are designed to prevent long term overheating of the insulation of the power cables due to sustained over current conditions. The loss of a power cable due to the operation of a cable limiter or a crab limiter section affects the overall robustness of the secondary network power distribution system and can reduce its capability in handling double contingency (N−2) events. The term "double contingency," or a network power distribution system designed to N−2 conditions, is the number of primary feeders that can be taken out of service or lost due to cable faults and still be capable of handling the total available load current. For example, in a three feeder network, a design that is rated "N−2" can lose 2 of the 3 feeders and still handle the load requirements.

Cable-to-cable limiters are complete units that include a cable-to-cable fusible element, a high temperature filler shell and an insulating sleeve.

Crab limiters provide protection for plural power cables at one common junction. Each power cable is electrically connected to its own separate fusible section. The fusible elements of the fusible sections are encased in a high temperature shell, which provides separate arcing chambers for each fusible section.

Replacing a crab limiter fusible section requires testing every crab take-off and every cable limiter to find the blown fusible element. Performing this operation takes time and costs money. The present design of known cable limiters and crab limiters is such that after they have operated, the entire cable limiter must be cut out and a new cable limiter placed into the power circuit. In the case of the crab limiter, after the last fusible element has cleared, the entire crab limiter is discarded and a new crab limiter is installed. For example, a 5-way/5-way crab limiter has five secondary cables coming in one side of the device, for which all five secondary cables have limiters. These are attached to five secondary cables outgoing from the opposite side of the device. Again, all five secondary cables have limiters. When the last limiter section has cleared, the entire crab limiter is removed and discarded.

There is room for improvement in cable limiters.

There is also room for improvement in crab limiters.

SUMMARY OF THE INVENTION

There exists a need for a cable limiter or crab limiter that employs a replaceable fusible element as well as a local annunciator that indicates (e.g., without limitation, below a manhole; in an underground vault) to service personnel that a particular cable limiter or crab limiter section has operated and that its fusible element needs to be replaced. Utilizing such a design makes the blown cable limiter or crab limiter section much easier to find and, thus, faster to bring back on line.

These needs and others are met by embodiments of the invention, which provide a main body, which houses an annunciator and includes a cavity that receives a replaceable fusible element.

In accordance with one aspect of the invention, a cable limiter comprises: a main body including a cavity; a replaceable fusible element, the cavity of the main body being structured to receive the replaceable fusible element; and an annunciator housed by the main body, the annunciator structured to annunciate status of the replaceable fusible element.

The replaceable fusible element may include a predetermined current rating and a member sized as a function of the predetermined current rating. The cavity may include an aperture sized to receive therein only the member of the replaceable fusible element having the predetermined current rating.

The annunciator may comprise a light and a parasitic air core sensor structured to power and illuminate the light responsive to current flowing through the replaceable fusible element.

The annunciator may comprise a piezoelectric transducer and a voltage sense circuit structured to power the piezoelectric transducer responsive to voltage across the replaceable fusible element.

The annunciator may comprise a wireless transmitter and a voltage sense circuit structured to power the wireless transmitter responsive to voltage across the replaceable fusible element.

The replaceable fusible element may include a predetermined current rating and a tab structured to permit only another correctly sized replaceable fusible element to be inserted into the cavity of the main body, the another correctly sized replaceable fusible element having the same predetermined current rating and the same tab as the replaceable fusible element.

The main body may further include a first conductive terminal structured to receive a first power cable, a second conductive terminal structured to receive a second power cable, a first conductive end member electrically coupled to the first conductive terminal, a second conductive end member electrically coupled to the second conductive terminal, a first external insulative member fixedly disposed about the first conductive terminal, a second external insulative member moveably disposed about the second conductive terminal, and an external clamp connecting the second external insulative member to the first external insulative member.

As another aspect of the invention, a crab limiter for a plurality of power cables comprises: a first side including a plurality of members; a second side including a plurality of members; a main conductive collector member; for each of the members of the first and second sides, a main body including a cavity; and for at least some of the members of the first and second sides, a replaceable fusible element, the cavity of a corresponding main body being structured to receive the replaceable fusible element, and an annunciator structured to annunciate status of the replaceable fusible element.

As another aspect of the invention, a cable limiter comprises: a main body including a cavity, a first conductive terminal structured to receive and secure a first power cable, a second conductive terminal structured to receive and secure a second power cable, a first conductive end member electrically coupled to the first conductive terminal and a second conductive end member electrically coupled to the second conductive terminal; and a replaceable fusible element, wherein the cavity of the main body is structured to receive the replaceable fusible element, wherein the first and second conductive end members are structured to mount the replaceable fusible element, wherein the cavity of the main body includes an aperture, and wherein the replaceable fusible element includes a predetermined current rating and a member structured to interlock with the aperture and permit only another correctly sized replaceable fusible element to be inserted into the cavity of the main body, the another correctly sized replaceable fusible element having the same predetermined current rating and the same member as the replaceable fusible element.

BRIEF DESCRIPTION OF THE DRAWINGS

A full understanding of the invention can be gained from the following description of the preferred embodiments when read in conjunction with the accompanying drawings in which:

FIG. 4 is a simplified isometric view of the entire 5-way/5-way crab limiter of FIG. 3.

FIG. 8 is an isometric view of the cable limiter of FIG. 1 with the second boot removed from the main body to show internal structures.

DESCRIPTION OF THE PREFERRED EMBODIMENTS

As employed herein, the term "number" shall mean one or an integer greater than one (i.e., a plurality).

As employed herein, the term "wireless" shall expressly include, but not be limited by, radio frequency (RF), light, visible light, infrared, ultrasound, wireless area networks, such as, but not limited to, IEEE 802.11 and all its variants (e.g., without limitation, 802.11a; 802.11b; 802.11g), IEEE 802.15 and all its variants (e.g., without limitation, 802.15.1; 802.15.3, 802.15.4), IEEE 802.16 and all its variants, other wireless communication standards (e.g., without limitation, ZigBee™ Alliance standard), HyperLan, DECT, PWT, pager, PCS, Wi-Fi, Bluetooth™, and cellular.

As employed herein, the term "cable limiter" means a power conductor limiter apparatus including a fusible element.

As employed herein, the terms "crab limiter" or "crab" mean a power conductor limiter apparatus including a plurality of fusible elements for a plurality of power conductors.

As employed herein, the term "fastener" refers to any suitable connecting or tightening mechanism expressly including, but not limited to, screws, bolts and the combinations of bolts and nuts (e.g. without limitation, lock nuts) and bolts, washers and nuts.

As employed herein, the statement that two or more parts are "coupled" together shall mean that the parts are joined together either directly or joined through one or more intermediate parts.

Example 1

Figure 1:
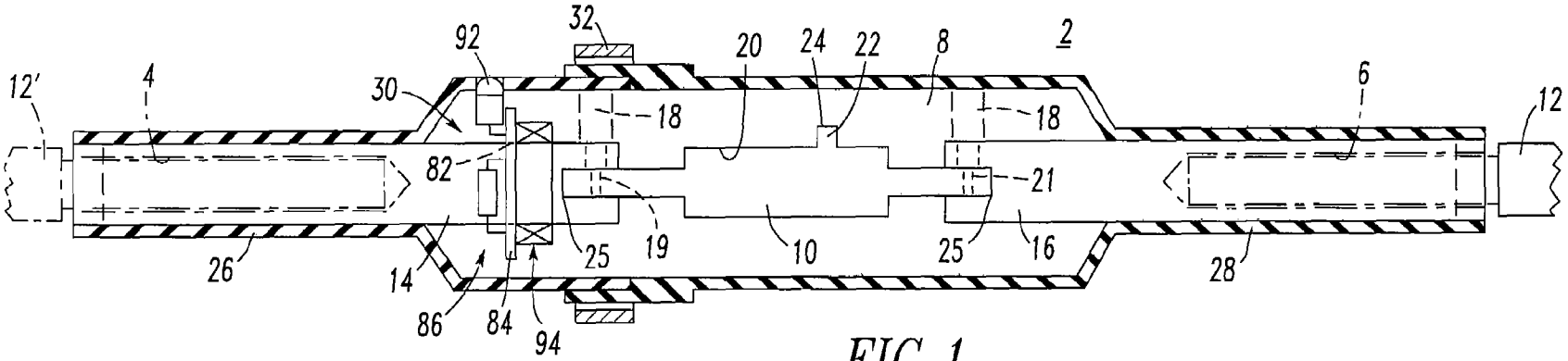
FIG. 1 is a vertical elevation view of an indicating cable limiter including a replaceable fusible element with fixed and removable boots cut away to show internal structures in accordance with an embodiment of the invention.
Figure 2:
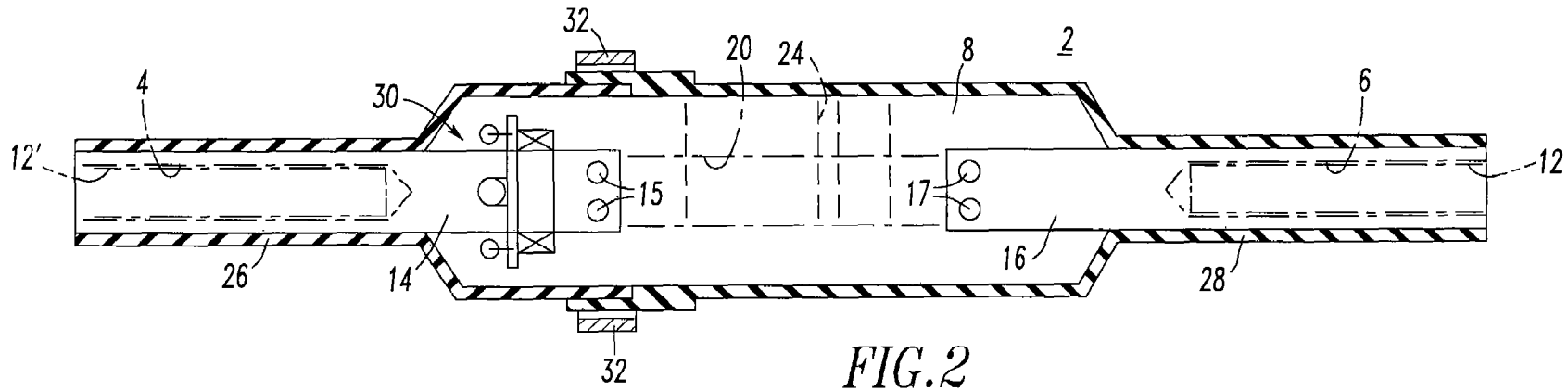
FIG. 2 is a plan view of the indicating cable limiter of FIG. 1, except that the replaceable fusible element has been removed to show internal structures.

Referring to FIGS. 1 and 2, a cable limiter apparatus 2 is shown. A conductive tube 4,6 (e.g., without limitation, made of tin coated copper) is molded into each end of a compound (e.g., without limitation, made of high temperature, heat resistant, cycloaliphatic resin), which makes up the main body 8 of the cable limiter apparatus 2. The apparatus 2, in turn, houses a replaceable fusible element 10. The two tubes 4,6 serve as cable crimp areas for power cables, such as 12', 12 (shown partially within the tubes 4,6 of FIG. 1), respectively. These tubes 4,6 are brazed into conductive end pieces 14,16 (e.g., without limitation, made of brazed copper), respectively, that serve as the mounting points for the replaceable fusible element 10. Two screws 18 (e.g., without limitation, stainless steel, angle point end, Allen head) (only two total screws 18 are shown in FIG. 1) in each of the end pieces 14,16 provide the compressive force needed to secure the replaceable fusible element 10 into the main body 8 through the apertures 15,17 of the end pieces 14,16 and the apertures 19,21, respectively, of the replaceable fusible element 10.

The replaceable fusible element 10 is located within a cavity 20 of the main body 8. The replaceable fusible element 10 is preferably enclosed in a suitably high temperature, high silica resin that can absorb the thermal shock of fuse interruption without significant collateral damage occurring to the main body 8. Preferably, each different size of various different fusible elements (e.g., 10,10', 10" of FIGS. 9A-9C) is interlocked by a corresponding different molded member (e.g., without limitation, tab 22 for element 10) made of the high temperature, high silica resin. For this molded tab 22, a corresponding mating aperture (e.g., without limitation, slot 24) is provided in the cavity 20 of the main body 8, such that only the correctly sized (i.e., proper current rating) fusible element 10 can be placed in that cavity 20. Preferably, the ends of the end pieces 14,16 have a circular cross-section (not shown) with a slot 25 along a diameter to receive one corresponding end of the fusible element 10.

Two boots 26,28 (e.g., without limitation, made of silicone rubber) fit over each end of the main body 8. One end has the first boot 26 fixed to protect an annunciator portion 30. The other end has the second boot 28, which is removable from the main body 8. After a clamp 32 (e.g., without limitation, made of a stainless steel, non-magnetic material) is removed or loosened (FIG. 8), the removable boot 28 can be slid down the power cable 12 (to the right of FIG. 1), which has been fixedly crimped into the tube 6 at that end. By removing the removable boot 28, access to the various hold-down screws 18 is provided. In turn, the spent replaceable fusible element 10 can be removed and a new replaceable fusible element (not shown) of only the correct size can be placed into the main body cavity 20. Then, the removable boot 28 can be repositioned (as shown in FIG. 1) and the same clamp 32 (best shown in FIG. 8) (shown in cross-section in FIGS. 1-2 for convenience of illustration) can be tightened in order to make a watertight seal between the two boots 26,28.

Example 2

Figure 9A:
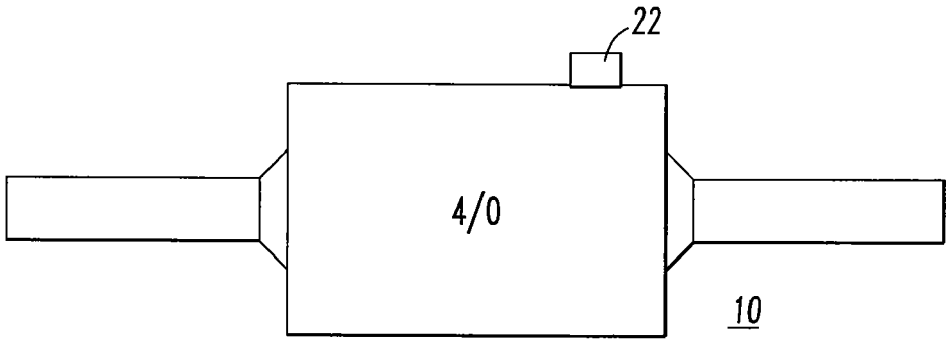
FIGS. 9A-9C are vertical elevation views of cable limiters in accordance with embodiments of the invention.
Figure 9B:
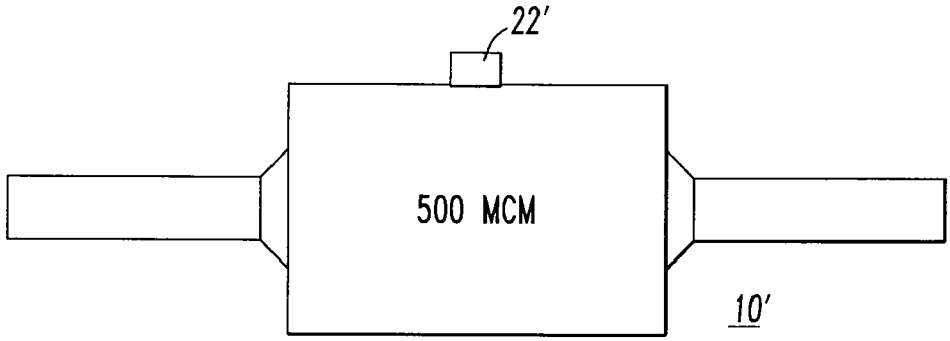
Figure 9C:
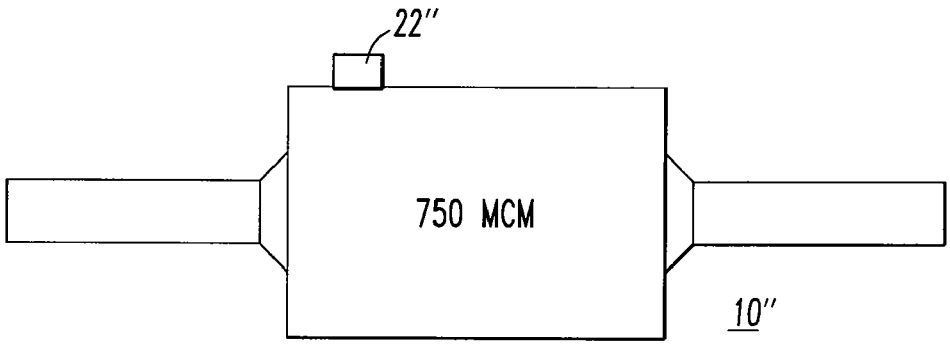

FIGS. 9A, 9B and 9C show different replaceable fusible elements 10,10',10" including different tabs 22,22',22" for 4/0, 500 MCM and 750 MCM applications, respectively. In this manner, the tabs 22' and 22" are not suitable for the cable limiter 2 of FIG. 1 because, unlike the tab 22, these tabs 22',22" do not mate with the slot 24.

Example 3

Figure 3:
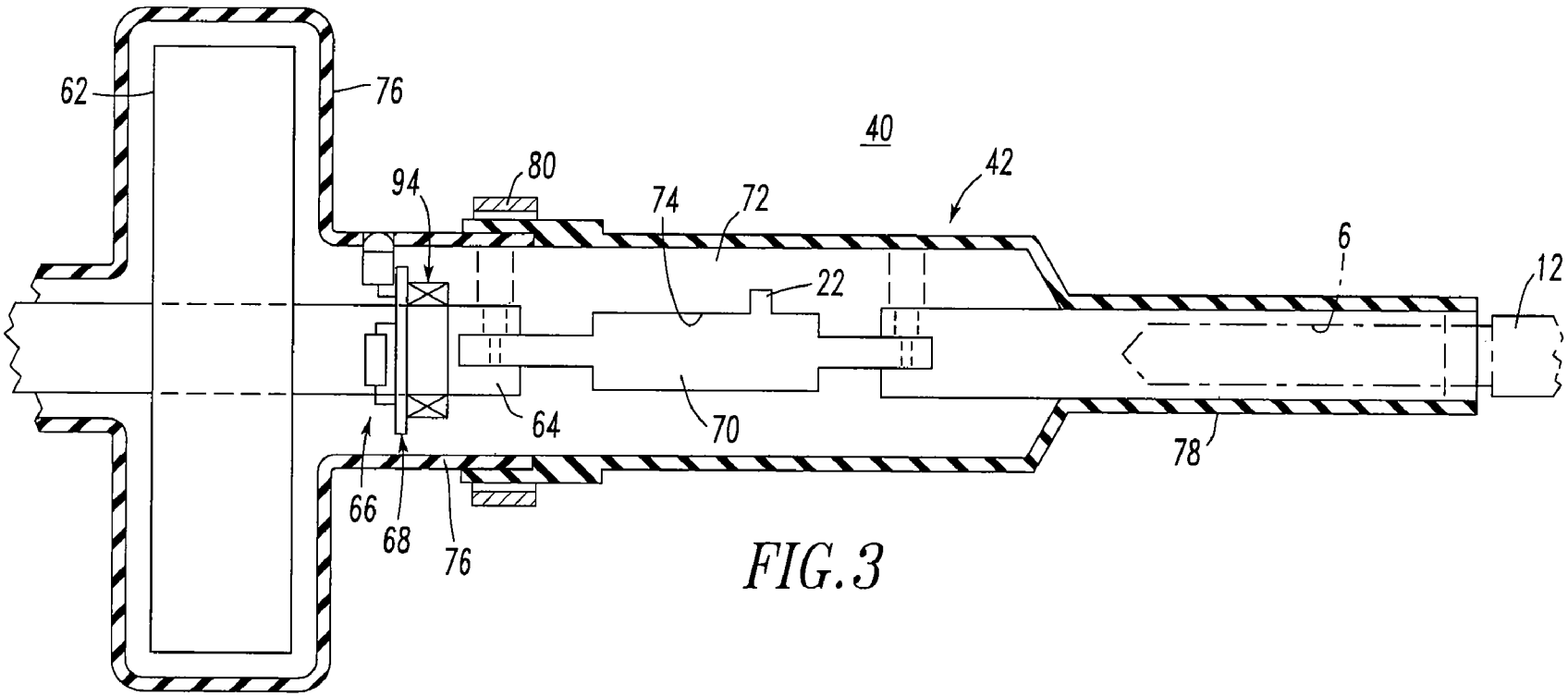
FIG. 3 is a vertical elevation view of a portion of an indicating 5-way/5-way crab limiter including a number of different replaceable fusible elements with fixed and removable boots cut away to show internal structures in accordance with another embodiment of the invention.

As shown in FIGS. 3 and 4, as an extension of the cable limiter apparatus 2 of FIGS. 1 and 2, a 5-way/5-way crab limiter 40 has five cable limiter sections 42,44,46,48,50 on one side and 52,54,56,58,60 on the opposite side emanating from each side of a conductive collector plate 62 (e.g., without limitation, made of solid copper with plural brazed copper conductive end pieces, such as 64). There is one input cable and one output cable on each side of the crab limiter 40 that feed four other cables on each side. Hence, there are ten cables in all, five on each side. Effectively, the crab limiter 40 includes ten cable limiters, as each is described above, having a conductive end piece 64 (e.g., without limitation, made of brazed copper) (which holds a sensing circuit 66 and one or more printed circuit boards (PCBs) 68 associated with annunciation of status (e.g., non-operated or conductive; operated or open) of the corresponding replaceable fusible element 70) mounted to the collector plate 62. The ten cable limiters may have the same or different current ratings. The main body 72 of each limiter section of the crab limiter 40 is preferably made from a high temperature, cycloaliphatic resin and incorporates a cavity 74 to accept the replaceable fusible element 70. The collector plate 62 and part of the main body 72 are preferably covered with high temperature silicone rubber 76. Each limiter section has a removable boot 78 (e.g., without limitation, made of silicone rubber) and a clamp 80 (e.g., without limitation, made of a stainless steel non-magnetic material) (shown in cross-section for convenience of illustration) to make the assembly watertight.

Example 4

Figure 5:
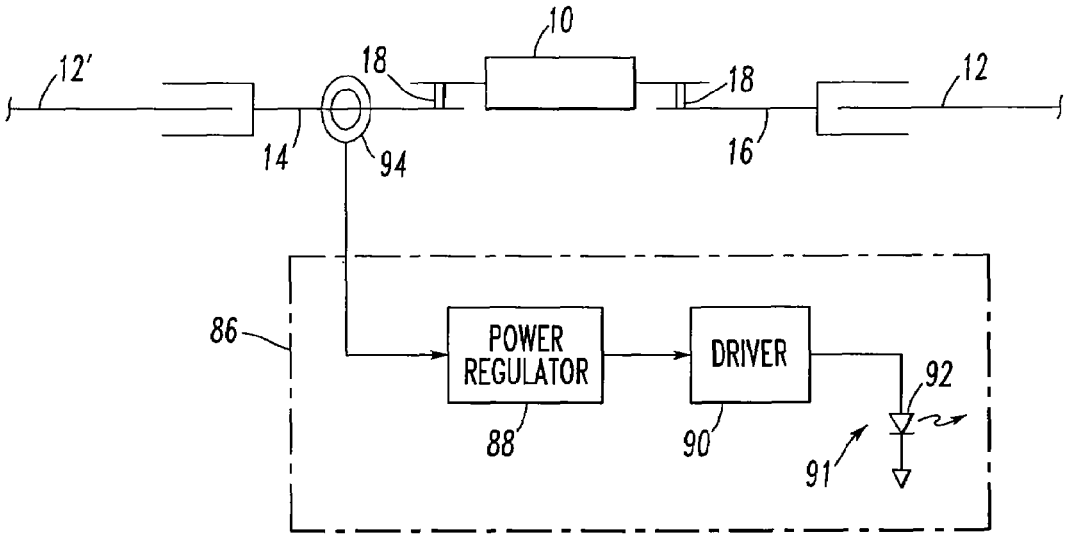
FIG. 5 is a block diagram in schematic form of a power supply and LED indicating circuit for a cable limiter in accordance with another embodiment of the invention.

Referring again to FIGS. 1 and 2, one side of the end piece 14 includes an opening 82 to accept a PCB 84 that contains, for example, electronic components 86 (FIG. 5) providing a power regulator 88 and driver 90 suitable to output a desired voltage and current to operate an annunciator 91 (e.g., a visual indicator, such as the example bright white light emitting diode (LED) 92). An example of a power regulator including a self-powered inductive coupling circuit and regulator circuit is disclosed in U.S. Patent Application Publication No. 2006/0076946, which is incorporated by reference herein.

The example LED 92 is located such that it points outward from the cable limiter apparatus 2. Next to the PCB 84 is a parasitic air core sensor 94 that encircles the end piece 14 which is electrically connected to a power cable 12'. This air core sensor 94 supplies voltage to the power regulator 88. The air core sensor 94, the power regulator 88 and driver 90 are preferably encapsulated in the high temperature, heat resistant cycloaliphatic resin compound that makes up the main body 8 of the cable limiter apparatus 2.

The extended tip of the LED 92 passes through the surface of the main body 8. The LED 92 is illuminated when suitable power flow passes from one end of the cable limiter terminal (e.g., tube 4) to the other cable limiter terminal (e.g., tube 6). If the replaceable fusible element 10 operates and opens for any reason, then the LED 92 is extinguished, thereby indicating to maintenance personnel that the replaceable fusible element 10 needs to be changed.

For example, fiber optic cables (not shown) can be connected to the output of the LED 92 and mounted at a convenient point for maintenance personnel to check multiple cable limiters (not shown) in any one location. This convenient point could be at the access portal of an underground vault (not shown), or the manhole entry (not shown) or the doorway (not shown) into an underground vault.

Example 5

Figure 6:
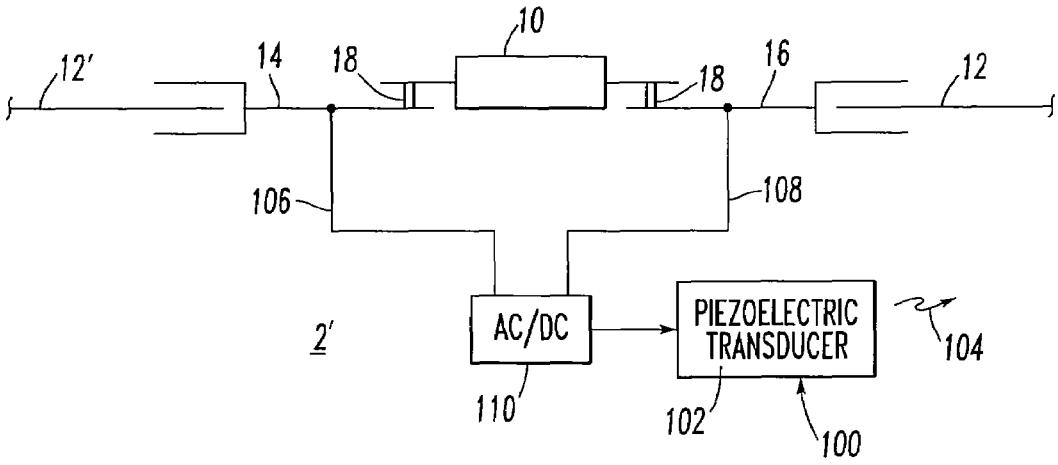
FIG. 6 is a block diagram in schematic form of a power supply and piezoelectric transducer for a cable limiter in accordance with another embodiment of the invention.

A suitable annunciator 100 (e.g., an audio annunciator, such as a piezoelectric transducer 102) is shown in FIG. 6. An output audio signal 104 is advantageously employed since the cable limiter apparatus 2' is normally located underground in a network vault (not shown) or below a manhole (not shown). The audio signal 104 may be reported, for example, by a passing citizen or by regular inspections by a maintenance crew from a power distribution company. The cable limiter apparatus 2' of this example is nearly the same as the apparatus 2 as described above in connection with the LED 92 of FIGS. 1 and 2. Other than the different audio annunciator 100, the only difference is that there are potential (voltage sense) conductors 106,108 that are electrically connected to the end pieces 14,16 on each side of where the replaceable fusible element 10 mounts within the limiter main body 8 (FIG. 1). These conductors 106,108 are electrically connected to the electronics of a suitable circuit, such as AC/DC power supply 110, that drives the piezoelectric transducer 102. In operation, whenever the replaceable fusible element 10 operates and opens, a voltage difference is measured across the now open fusible element. This voltage supplies the operating power for AD/DC power supply 110, which permits the piezoelectric transducer 102 to be energized and heard (e.g., without limitation, as a "chirp"). For example, the piezoelectric transducer 102 is pulsed approximately once every second or at some suitable rate and suitable volume dependent upon the voltage difference sensed across the open fusible element 10. This embodiment supplies the audible signal 104 that is suitable for a below grade, underground vault (not shown). After the maintenance crewperson enters the underground vault, he/she follows the sound to pinpoint the location of the fusible element 10 that has operated.

Example 6

Figure 7:
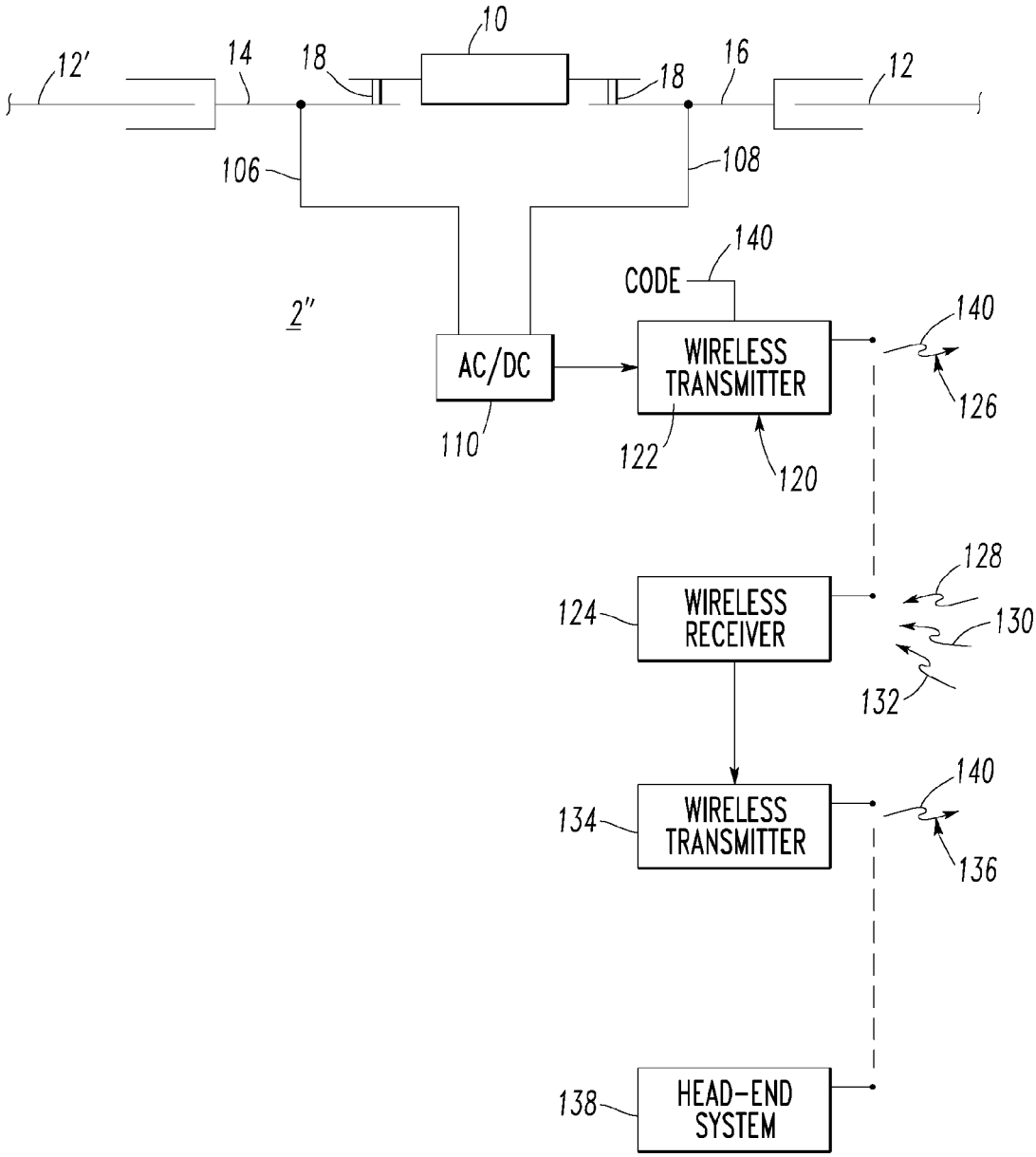
FIG. 7 is a block diagram in schematic form of a power supply and wireless transmitter for a cable limiter in accordance with another embodiment of the invention.

In the example of FIG. 7, the annunciator 120 is provided by wireless communication to a remote location. A wireless transmitter 122 is powered, for example, from a voltage sense circuit formed by the AC/DC power supply 110 connected across the replaceable fusible element 10. The power supply 110 supplies voltage to power the wireless transmitter 122, which is part of the main body 8 (FIG. 1) of the cable limiter apparatus 2", only after the replaceable fusible element 10 has operated and opened. The wireless transmitter 122 cooperates with a corresponding wireless receiver 124 mounted in suitably close proximity to the wireless transmitter 122 (e.g., within the same confines as the underground vault (not shown)). The wireless receiver 124 serves as a data concentrator for wireless signals 126, 128,130,132 from various connected wireless transmitters/cable limiters in any one location, and re-transmits the information over a suitably longer range wireless system 134 (e.g., without limitation, Cellnet™; any suitable cellular network system; any suitable wireless system) through wireless signal 136. A head-end system 138 receives any calls by exception (i.e., calls which now indicate that the replaceable fusible element 10 has operated and cleared) and gives a unique location indicator code 140, which uniquely pinpoints the cable limiter's location on the power distribution system.

The disclosed cable limiter apparatus 2,2',2" preclude the necessity to remove an entire spent cable limiter, strip cable insulation, and re-crimp and install a new cable limiter. Only the replaceable fusible element 10 needs to be replaced after it clears the power circuit when the downstream power cable 12, which is fed by the upstream cable limiter or crab limiter section, faults either phase-to-phase or phase-to-ground.

The disclosed cable limiter apparatus 2,2',2" include removable spent limiter sections 10 that may be removed and replaced during the repair of the power circuit cable(s) 12,12'.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A cable limiter comprising:

a main body including a cavity;

a replaceable fusible element, the cavity of said main body being structured to receive said replaceable fusible element; and an annunciator housed by said main body, said annunciator structured to annunciate status of said replaceable fusible element, wherein said annunciator comprises a piezoelectric transducer and a voltage sense circuit structured to power said piezoelectric transducer responsive to voltage across said replaceable fusible element said replaceable fusible element includes a predetermined current rating and a member sized as a function of said predetermined current rating; wherein said cavity includes an aperture sized to receive therein only said member of said replaceable fusible element having said predetermined current rating; wherein said main body includes a first conductive end member and a second conductive end member, said first and second conductive end members removably mounting said replaceable fusible element; and wherein the member of said replaceable fusible element is between and offset from said first and second conductive end members, which mount said replaceable fusible element.

2. The cable limiter of claim 1 wherein said main body includes a first conductive tube structured to receive and secure a first power cable, a second conductive tube structured to receive and secure a second power cable, a first conductive end member electrically coupled to said first conductive tube and a second conductive end member electrically coupled to said second conductive tube, said first and second conductive end members being structured to mount said replaceable fusible element.

3. The cable limiter of claim 1 wherein said piezoelectric transducer outputs an audible output when said replaceable fusible element has been operated and said voltage is across said replaceable fusible element.

4. The cable limiter of claim 1 wherein said annunciator comprises a wireless transmitter and a voltage sense circuit structured to power said wireless transmitter responsive to voltage across said replaceable fusible element.

5. The cable limiter of claim 4 wherein said wireless transmitter outputs a wireless signal when said replaceable fusible element has been operated and said voltage is across said replaceable fusible element.

6. The cable limiter of claim 1 wherein said main body is structured to be permanently mounted to two power conductors electrically connected in series with said replaceable fusible element.

7. The cable limiter of claim 1 wherein said main body is made from a cycloaliphatic resin.

8. The cable limiter of claim 1 wherein said replaceable fusible element is encapsulated in a heat protective silica resin.

9. The cable limiter of claim 1 wherein said main body further includes a first conductive terminal structured to receive a first power cable, a second conductive terminal structured to receive a second power cable, a first conductive end member electrically coupled to said first conductive terminal, a second conductive end member electrically coupled to said second conductive terminal, a first external insulative member fixedly disposed about said first conductive terminal, a second external insulative member moveably disposed about said second conductive terminal, and a clamp connecting said second external insulative member to said first external insulative member, said clamp being external to both of said first and second external insulative members when connecting said second external insulative member to said first external insulative member.

10. The cable limiter of claim 1 wherein said main body further includes a first conductive terminal structured to receive a first power cable, a second conductive terminal structured to receive a second power cable, a first conductive end member electrically coupled to said first conductive terminal, and a second conductive end member electrically coupled to said second conductive terminal; wherein said first conductive end member includes a number of first apertures; wherein said second conductive end member includes a number of second apertures; wherein said replaceable fusible element includes a first end including a number of third apertures, a second end including a number of fourth apertures, a number of first fasteners coupling the first end of said replaceable fusible element to said first conductive end member at the first and third apertures, and a number of second fasteners coupling the second end of said replaceable fusible element to said second conductive end member at the second and fourth apertures.

11. A crab limiter for a plurality of power cables, said crab limiter comprising:

a first side including a plurality of members;

a second side including a plurality of members;

a main conductive collector member;

for each of the members of said first and second sides, a main body including a cavity; and for at least some of the members of said first and second sides, first and second conductive end members, a replaceable fusible element, the cavity of a corresponding main body being structured to receive said replaceable fusible element, and an annunciator structured to annunciate status of said replaceable fusible element, wherein said first and second conductive end members mount said replaceable fusible element, wherein said replaceable fusible element includes a predetermined current rating and a tab structured to permit only another correctly sized replaceable fusible element to be inserted into the cavity of said main body, said another correctly sized replaceable fusible element having the same predetermined current rating and the same tab as said replaceable fusible element, wherein the tab of said replaceable fusible element is between and offset from said first and second conductive end members, which mount said replaceable fusible element, and wherein said cavity includes an aperture sized to receive therein only the tab of said replaceable fusible element having said predetermined current rating.

12. The crab limiter of claim 11 wherein said first side includes five of said members of said first side; and wherein said second side includes five of said members of said second side.

13. The crab limiter of claim 11 wherein said main conductive collector member is a generally planar member.

14. A cable limiter comprising:

a main body including a cavity, a first conductive terminal structured to receive and secure a first power cable, a second conductive terminal structured to receive and secure a second power cable, a first conductive end member electrically coupled to said first conductive terminal and a second conductive end member electrically coupled to said second conductive terminal; and a replaceable fusible element, wherein the cavity of said main body is structured to receive said replaceable fusible element, wherein said first and second conductive end members mount said replaceable fusible element, wherein the cavity of said main body includes an aperture, wherein said replaceable fusible element includes a predetermined current rating and a member structured to interlock with said aperture and permit only another correctly sized replaceable fusible element to be inserted into the cavity of said main body, said another correctly sized replaceable fusible element having the same predetermined current rating and the same member as said replaceable fusible element, and wherein the member of said replaceable fusible element is between and offset from said first and second conductive end members which replaceably mount said replaceable fusible element.

15. The cable limiter of claim 14 wherein said main body further includes an annunciator structured to annunciate status of said replaceable fusible element.

16. The cable limiter of claim 15 wherein said annunciator comprises a light and a parasitic air core sensor structured to power and illuminate said light responsive to current flowing through said replaceable fusible element.

17. The cable limiter of claim 16 wherein said light is illuminated when said replaceable fusible element is conducting said current flowing therethrough and said replaceable fusible element has not been operated.

18. The cable limiter of claim 14 wherein said first conductive terminal is structured to permanently secure said first power cable; wherein said second conductive terminal is structured to permanently secure said second power cable; and wherein said first and second conductive end members are structured to remove said replaceable fusible element and mount said another correctly sized replaceable fusible element.

* * * * *